US010392815B1

(12) United States Patent
Brawner et al.

(10) Patent No.: US 10,392,815 B1
(45) Date of Patent: Aug. 27, 2019

(54) WALL PAD SLEEVE

(71) Applicant: Litania Sports Group, Inc., Champaign, IL (US)

(72) Inventors: Charles A. Brawner, Urbana, IL (US); Gregory W. Luebbering, Heyworth, IL (US)

(73) Assignee: Litania Sports Group, Inc., Champaign, IL (US)

( * ) Notice: Subject to any disclaimer, the term of this patent is extended or adjusted under 35 U.S.C. 154(b) by 0 days.

(21) Appl. No.: 16/171,462

(22) Filed: Oct. 26, 2018

Related U.S. Application Data

(60) Provisional application No. 62/583,262, filed on Nov. 8, 2017.

(51) Int. Cl.
*E04F 19/02* (2006.01)
*E04F 13/075* (2006.01)
*E04H 3/14* (2006.01)

(52) U.S. Cl.
CPC ..... *E04F 19/02* (2013.01); *E04F 13/075* (2013.01); *E04H 3/14* (2013.01)

(58) Field of Classification Search
CPC ..... E04F 13/075; E04F 19/02; E04H 3/14
See application file for complete search history.

(56) References Cited

U.S. PATENT DOCUMENTS 3,451,153 A * 6/1969 Dohanyos ..... A47G 1/08 40/741
3,784,043 A * 1/1974 Presnick ..... B65D 88/528 220/4.28
4,356,648 A * 11/1982 Beaulieu ..... A47G 1/0605 40/757
4,462,186 A * 7/1984 Fuller ..... E06B 3/9641 160/376
4,570,406 A * 2/1986 DiFazio ..... E04C 2/384 160/381
4,608,800 A * 9/1986 Fredette ..... E04F 13/0803 52/211
4,862,612 A * 9/1989 Sugihara ..... A47G 1/10 40/782
5,647,172 A * 7/1997 Rokicki ..... E06B 3/20 160/381
5,921,056 A * 7/1999 Weiss ..... E06B 1/62 52/212
5,927,668 A * 7/1999 Cyrell ..... A47B 81/06 248/316.1
6,094,793 A 8/2000 Biro
6,094,796 A * 8/2000 Biro ..... A47H 2/00 29/412
6,377,320 B1 * 4/2002 Ananian ..... G06F 1/1609 312/7.2
6,647,652 B1 * 11/2003 Seiber ..... G09F 7/18 40/606.1
6,769,562 B2 * 8/2004 Schroeder ..... H02G 3/123 174/50
6,865,836 B2 * 3/2005 Sachs-Lavery ..... A47G 1/08 248/467

(Continued)

*Primary Examiner* — James M Ference
(74) *Attorney, Agent, or Firm* — Philip L. Bateman

(57) ABSTRACT

A wall pad sleeve is assembled from four corner pieces and four side rails. Each corner piece and each side rail forms a channel with a base, a front flange, and a rear flange. When installed, the flanges cover a portion of the front face of the wall pad and a portion of the rear face of the wall pad.

11 Claims, 6 Drawing Sheets

(56) References Cited

U.S. PATENT DOCUMENTS

| | | | | |
|---|---|---|---|---|
| 7,007,735 | B1 * | 3/2006 | Lake | E06B 9/52 160/374.1 |
| 7,146,774 | B2 * | 12/2006 | Fredette | E04F 13/0864 52/656.6 |
| 7,624,548 | B2 * | 12/2009 | Hansen | E04G 21/24 52/202 |
| 7,877,825 | B1 * | 2/2011 | Marshall | A47K 3/30 4/612 |
| 8,028,489 | B1 * | 10/2011 | Lawrence | E06B 3/9641 52/204.57 |
| 8,069,622 | B2 * | 12/2011 | Mees | E06B 3/988 52/213 |
| 8,683,771 | B2 * | 4/2014 | Sawyers | E06B 9/52 29/525.08 |
| 8,777,035 | B2 * | 7/2014 | Gagne | H02G 3/121 220/3.3 |
| 8,966,839 | B2 * | 3/2015 | Rebman | E06B 3/28 52/202 |
| 8,985,364 | B2 * | 3/2015 | Gagne | H02G 3/36 220/3.3 |
| 9,145,670 | B2 * | 9/2015 | Hawkins | E02B 3/068 |
| 9,281,664 | B2 * | 3/2016 | David | E04F 19/08 |
| 10,034,562 | B2 * | 7/2018 | Kumar | A47G 1/08 |
| 2002/0104276 | A1 * | 8/2002 | Lucas, Jr. | E06B 7/16 52/204.53 |
| 2002/0166299 | A1 * | 11/2002 | Day | E06B 3/9624 52/211 |
| 2004/0250475 | A1 * | 12/2004 | Seaman | E06B 3/92 49/501 |
| 2006/0225378 | A1 * | 10/2006 | Hu | B65D 7/14 52/648.1 |
| 2018/0016800 | A1 * | 1/2018 | McGowan | E04F 19/0495 |

* cited by examiner

WALL PAD SLEEVE

CROSS-REFERENCE TO RELATED APPLICATION

This application claims the benefit of U.S. Provisional Application Ser. No. 62/583,262, Nov. 8, 2017.

FIELD OF THE INVENTION

This invention relates to receptacles and buildings. More particularly, this invention relates to wall pad sleeves.

BACKGROUND OF THE INVENTION

Gymnasium walls are often covered with wall pads to reduce the possibility of injury when an athlete hits the wall. The wall pads are typically made of foam covered in thin sheets of polyvinyl chloride (vinyl) or other suitable polymer. Gymnasium walls commonly contain electrical outlets and switches, fire extinguishers, thermostats, controls, etc. that must be accessible. When gymnasium walls are covered with wall pads, holes must be provided in the wall pads to provide this access.

The holes in the wall pads are sometimes left unfinished, but this is unattractive and can lead to unraveling or other damage to the wall pad. The exposed foam surfaces around the perimeter of the hole are sometimes patched with pieces of vinyl, but this procedure is time consuming and creates uneven results. In addition, the result is unattractive and not durable. A more common solution is to place a one-piece molded polymeric (plastic) wall pad sleeve into the hole. One-piece molded plastic wall pad sleeves provide an attractive appearance and prevent damage to the wall pad, but are not variable in cross-sectional size. Therefore, a separate mold must be made for every different hole size.

Wall pad sleeves that can be used with wall pads of different thickness or with holes of different cross-sectional size have been disclosed. Schroeder, U.S. Pat. No. 6,769,562, Aug. 3, 2004, discloses a one-piece molded polymeric wall pad sleeve that is suited for wall pads of differing thicknesses, but is suited for only one cross-sectional size. For example, the wall pad sleeve shown in the drawings fits only a standard electrical box. McGowan et al., U.S. Pat. Appin. Publn. No. 2018/0016800, Jan. 18, 2018, discloses a wall pad sleeve for holes in wall pad having varying size and shape. The McGowan et al. wall pad sleeve has a plurality of corner pieces and side rails that are connected with connectors. The side rails are cut to the desired size at the installation site. The corner pieces and side rails butt against each other so the side rails must be cut to the precise length.

Other types of products containing variable length side rails with connectors have also been disclosed. For example, Biro, U.S. Pat. No. 6,094,796, Aug. 1, 2000, discloses a valance and Day, U.S. Pat. Appin. Publn. No. 2002/0166299, Nov. 14, 2002, discloses a door frame.

Accordingly, there is a demand for a wall pad sleeve that provides an attractive appearance to the wall pad, prevents damage to the wall pad, is easily modified to fit holes of varying size without requiring precise cuts, fits wall pads of varying depth, does not require the use of connectors, is easily installed, and is durable.

SUMMARY OF THE INVENTION

The general object of this invention is to provide an improved wall pad sleeve. A more particular object is to provide a wall pad sleeve that provides an attractive appearance to the wall pad, prevents damage to the wall pad, is easily modified to fit holes of varying size without requiring precise cuts, fits wall pads of varying depth, does not require the use of connectors, is easily installed, and is durable.

We have invented an improved wall pad sleeve. The sleeve comprises four corner pieces and four side rails connectable together to form a rectangular assembly for covering a perimeter of a rectangular hole in a wall pad. Each side rail extends between two corner pieces and each corner piece connects two side rails. Each of the four corner pieces comprises: (i) a first rectangular base section having a front, a rear, an outer side, and an inner side; (ii) a second rectangular base section having a front, a rear, an outer side, and an inner side, the first base and the second base connected together along their inner sides and forming a right angle to each other; (iii) a front flange with an interior face extending from the fronts of the first base and the second base and being perpendicular to the front base and the second base; and (iv) a rear flange with an interior face extending from the rears of the first base and the second base and being perpendicular to the front base and the second base, the distance between the interior faces of the front flange and the rear flange defining an interior depth. Each of the four side rails comprises: (i) a rectangular base section having a front, a rear, and two sides; (ii) a front flange with an interior face and an exterior face extending from the front that is perpendicular to the base; and (iii) a rear flange with an interior face and an exterior face extending from the rear that is perpendicular to the base, the distance between the interior faces of the front flange and rear flange defining an interior depth, and the distance between the exterior faces of the front flange and rear flange defining an exterior depth.

The wall pad sleeve of this invention provides an attractive appearance to the wall pad, prevents damage to the wall pad, is easily modified to fit holes of varying size without requiring precise cuts, fits wall pads of varying depth, does not require the use of connectors, is easily installed, and is durable.

DETAILED DESCRIPTION OF THE INVENTION

Figure 1:
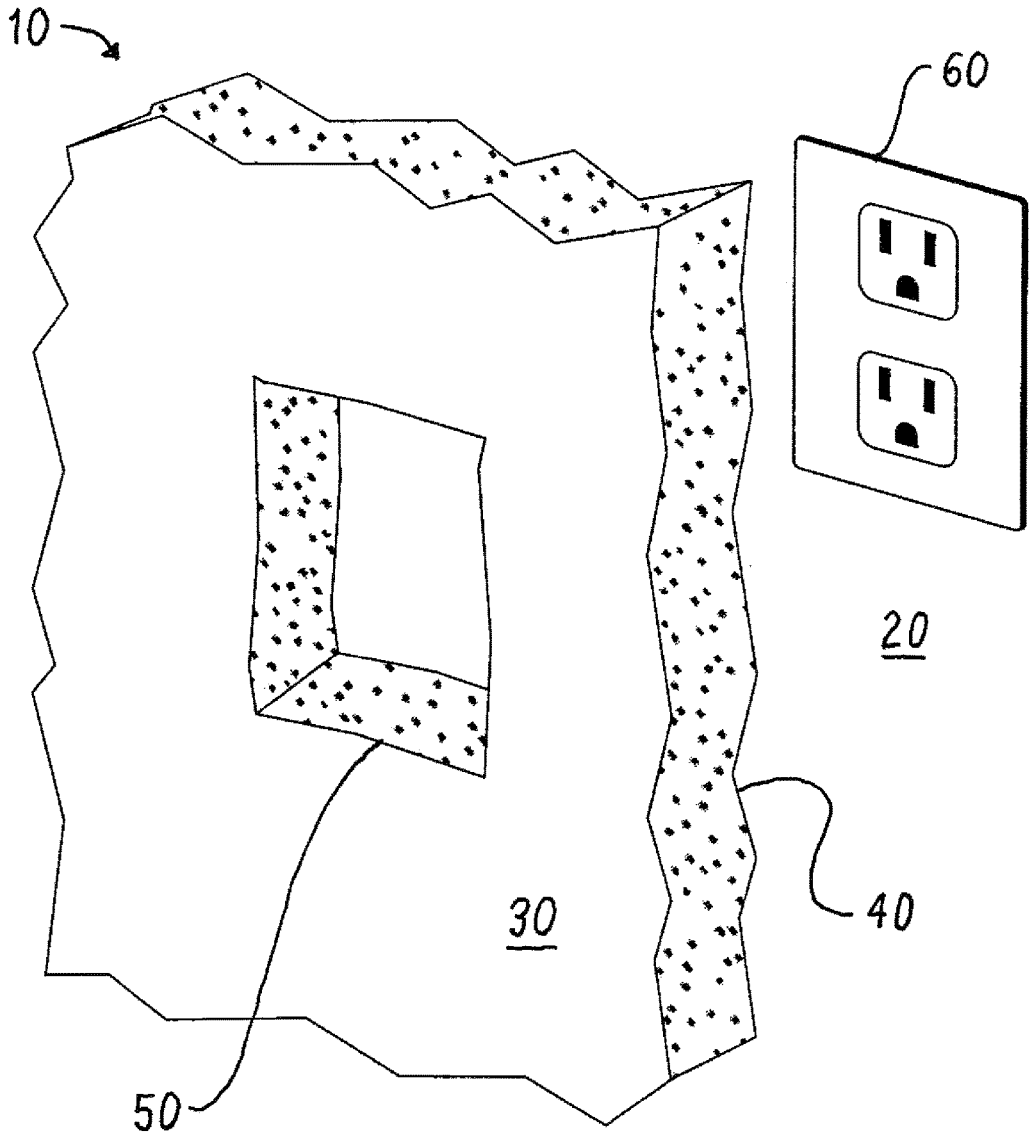
FIG. 1 (PRIOR ART)
FIG. 1 is a perspective view of a prior art wall pad with a hole for access to the wall.

This invention is best understood by reference to the drawings. Referring first to FIG. 1, a prior art wall pad 10 covers a wall 20. The wall pad contains a front face 30, a rear face 40, and a cut-out rectangular hole 50 to provide access to an electrical fixture 60, fire extinguisher, or other thing on the wall. The hole creates four exposed interior wall surfaces in the wall pad. The wall pad is conventional and is typically made of foam covered with a thin sheet of vinyl or the like.

The wall pad sleeve of this invention covers the exposed wall surfaces around the perimeter of the hole when installed.

Figure 2:
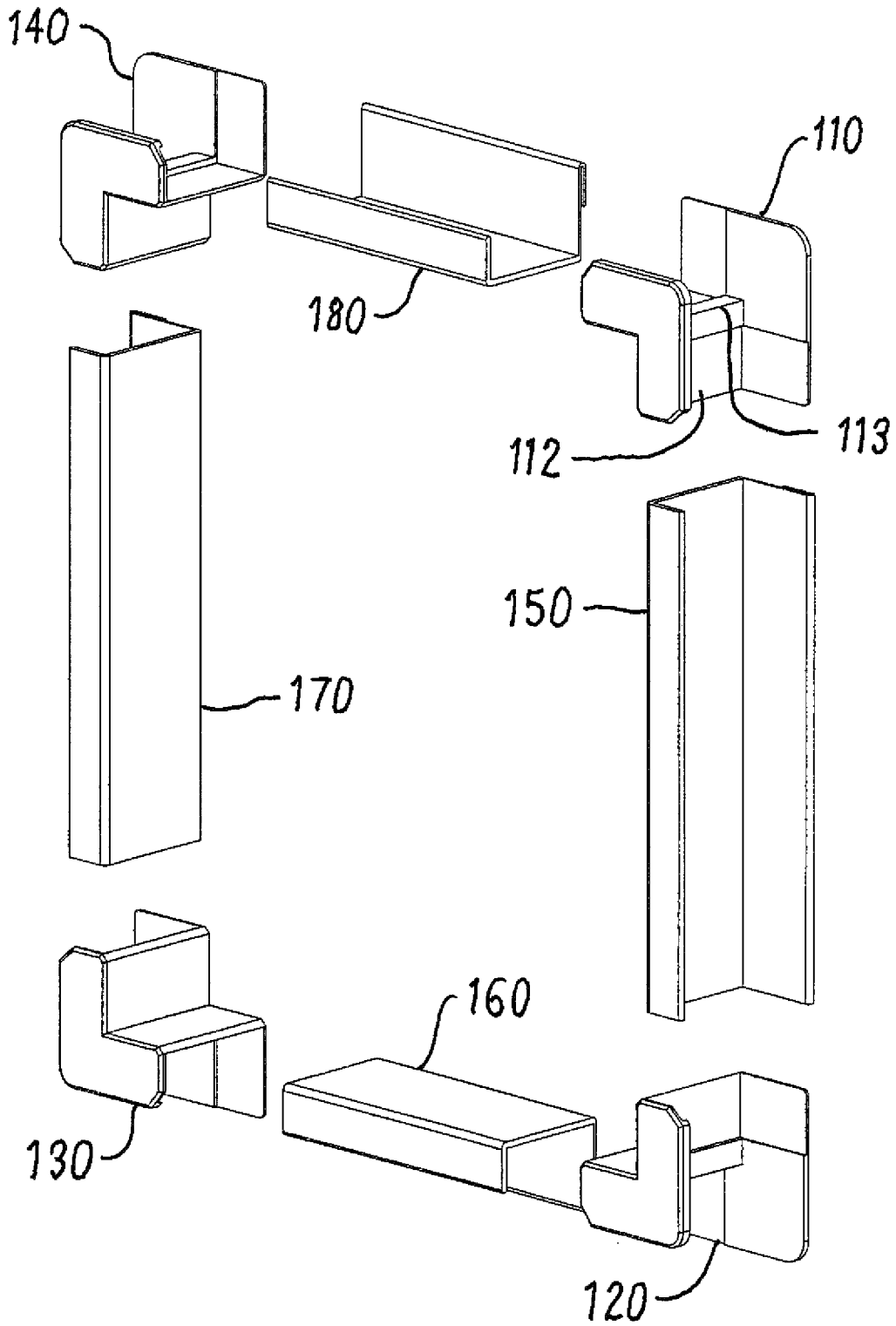
FIG. 2 is a perspective exploded view of a preferred embodiment of the wall sleeve of this invention.
Figure 3:
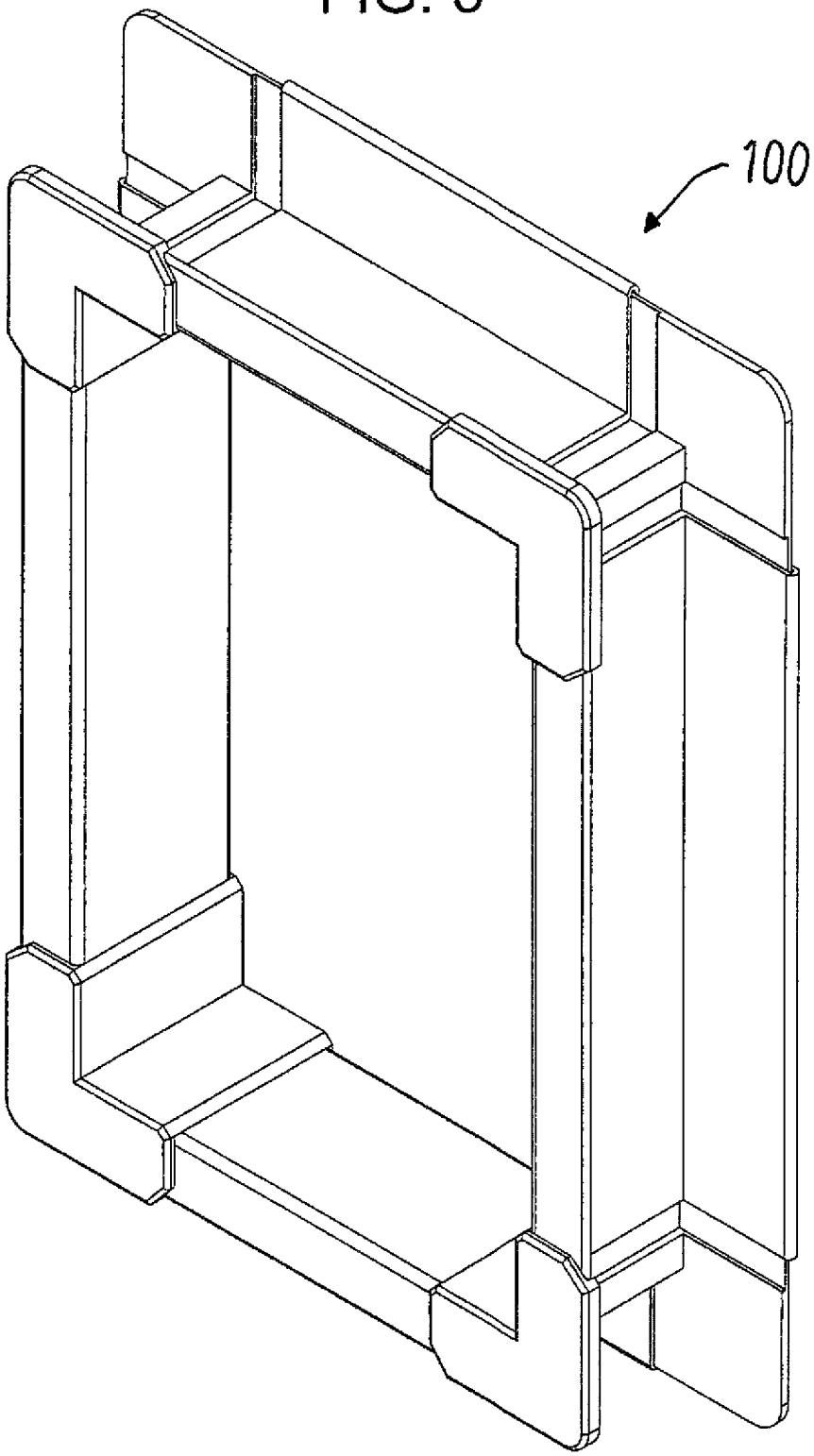
FIG. 3 is a perspective assembled view thereof.
Figure 4:
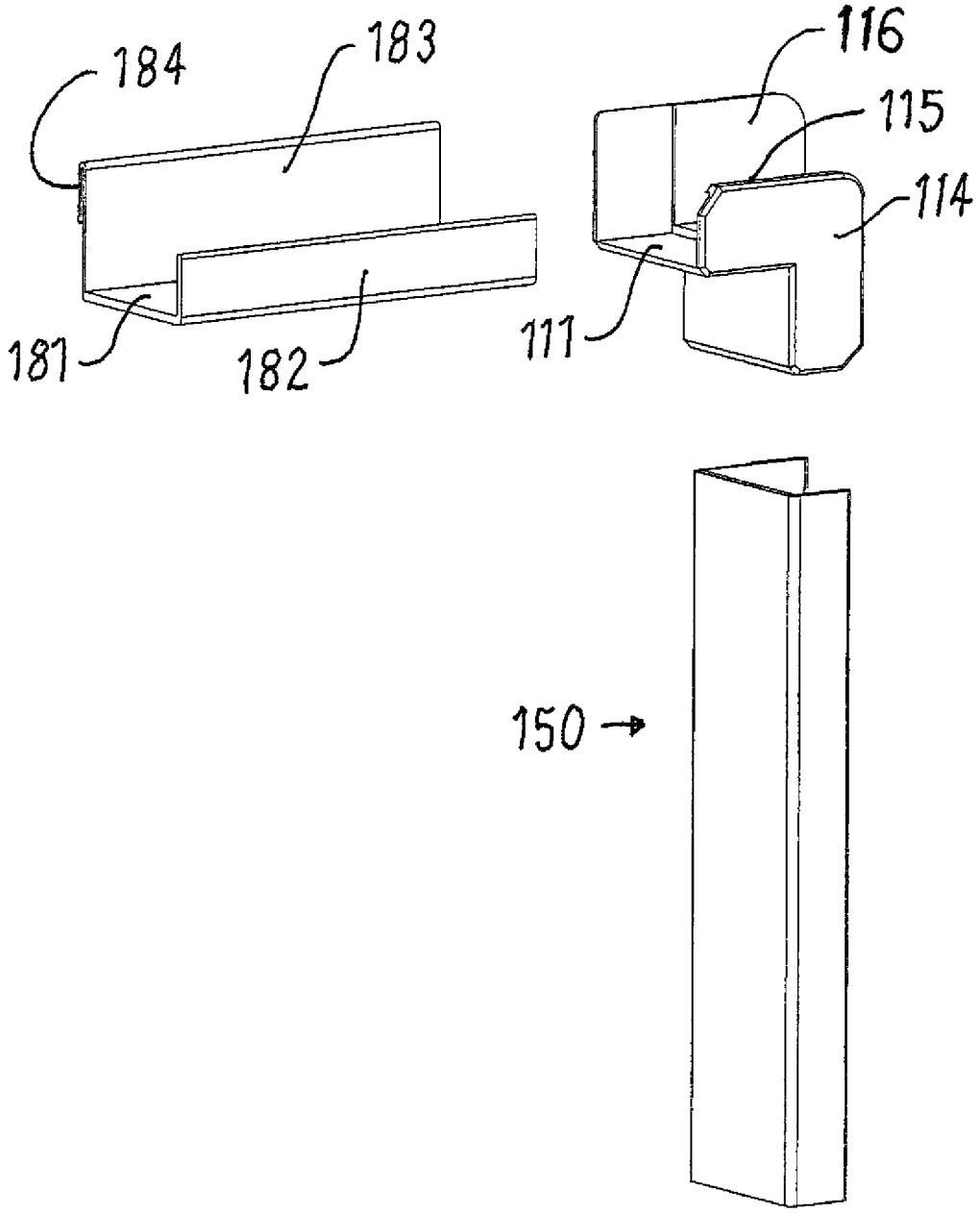
FIG. 4 is a detailed view thereof showing one corner piece and two side rails.

Referring now to FIGS. 2 to 4, the wall pad sleeve 100 of this invention comprises four corner pieces and four side rails. Each corner piece and each side rail forms a channel having a base and two flanges (side walls). The corner pieces overlap the adjacent side rails when assembled. The corner pieces can be identified by their assembled positions as upper right 110, lower right 120, lower left 130, and upper left 140. The side rails can be identified by their assembled positions as right 150, lower 160, left 170, and upper 180.

The four corner pieces are preferably identical so only one is described. Referring now to the upper right corner piece 110, the corner piece has two rectangular base sections 111 and 112 connected together along their common inner side 113. The point of connection is preferably thickened to provide additional strength. The two base sections form a right angle to each other (are perpendicular to each other). A front flange 114 extends from the fronts of the bases and is perpendicular to the bases. The front flange preferably includes an inwardly-directed shoulder 115 along the outer edge of its interior face to provide additional stability to the assembled sleeve. A rear flange 116 extends from the rears of the bases and is perpendicular to the bases. The rear flange is preferably taller in height than the front flange to provide additional area for attachment to the rear face of the wall pad.

The four side rails preferably vary, if at all, only in length so only one is described. Referring to the upper side rail 180, the side rail has a rectangular base section 181. A front flange 182 extends from the front of the base and is perpendicular to the base. A rear flange 183 extends from the rear of the base and is perpendicular to the base. The rear flange is preferably taller (higher) than the front flange.

The wall pad sleeve is assembled by cutting the side rails to the desired length, if necessary, and then sliding the eight component pieces together as they are positioned in the hole in the wall pad. The corner pieces overlap the side rails so the length of the side rails need not be precise. A variance of about one-half to one inch is typically acceptable. The overlapping also hides the cut ends of the side rails that may be jagged or rough behind the finished corner pieces.

Figure 5:
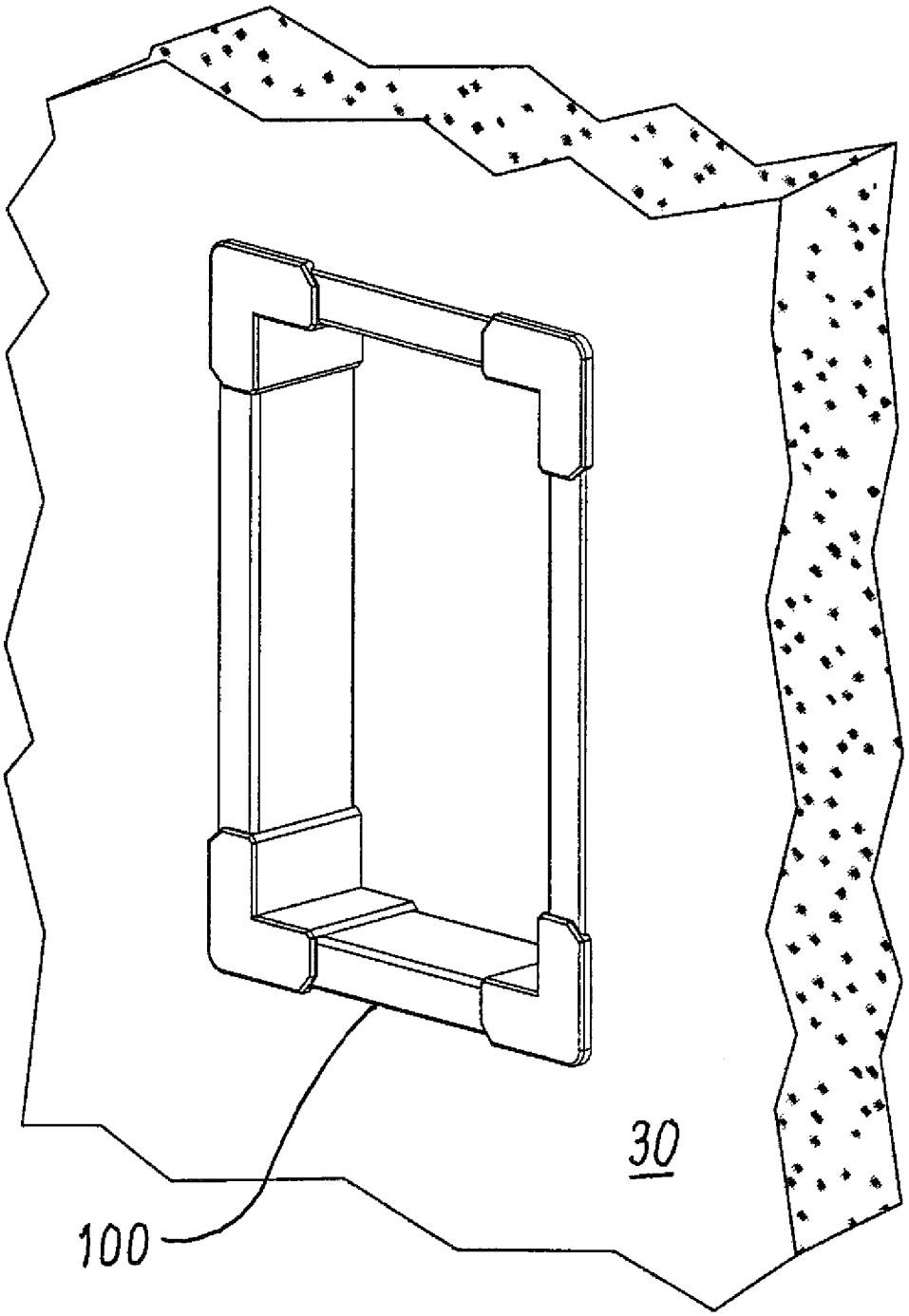
FIG. 5 is perspective view showing the front of a wall pad containing the wall pad sleeve.
Figure 6:
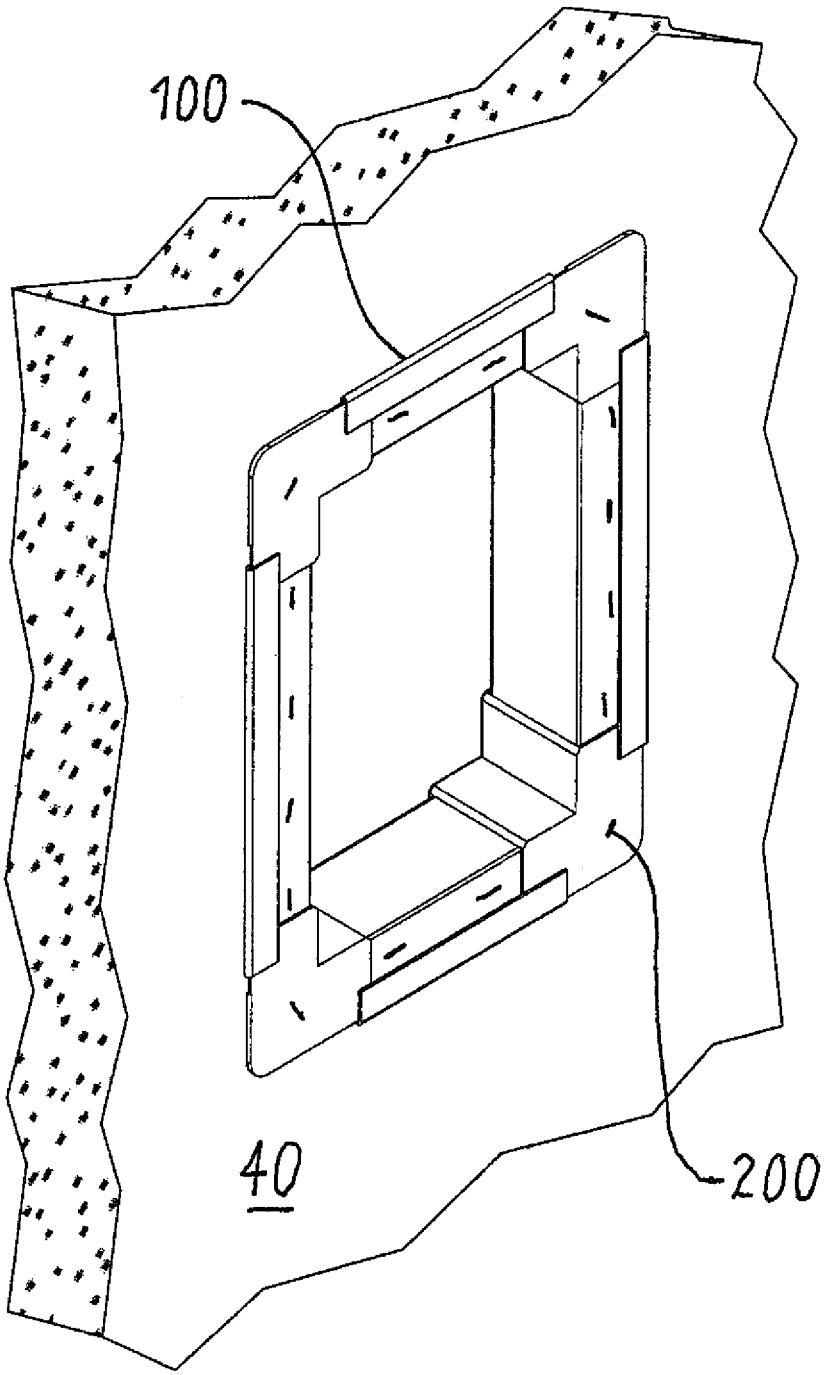
FIG. 6 is a perspective view showing the rear of a wall pad containing the wall pad sleeve.

The wall pad sleeve is shown assembled and in place in a hole in a wall pad in FIGS. 5 and 6. The front and rear flanges of each side rail fit tightly within the front and rear flanges of each connected corner piece. To enable such a fit, the exterior depth of the side rails (the distance between the exterior faces of the flanges of the side rails) is preferably slightly less than the interior depth of the corner pieces (the distance between the interior faces of the flanges of the corner pieces). Both the side rails and the corner pieces straddle the wall pad (the distances between the interior faces of their flanges are equal to or greater than the depth of the wall pad) so the front and rear flanges extend over a portion of the front and rear faces of the wall pad.

In the preferred embodiment, the rear flange of each side rail is the same height as the rear flange of the corner pieces and the rear flange of each side rail includes a lip 184 that fits over the rear flange of the corner piece to provide a more secure connection. In the preferred embodiment, the front flange of each side rail is slightly shorter in height than the front flange of the corner pieces to fit within the shoulder on the outer edge of the interior face. Once assembled, the wall pad sleeve is preferably secured to the wall pad by inserting staples 200 or other suitable fasteners through the flanges and into the rear face of the wall pad. If desired, the side rails and the corner pieces are secured together with adhesives.

The wall pad sleeve is made of a polymer that is durable and flexible so that it does not detract from the safety functions of the wall pad itself. The material is also easily cut with a saw or knife so that the side rails can be cut to the desired size during installation. Suitable polymers include thermosets, thermoplastics, combinations thereof, and the like. A preferred polymer is a thermoplastic vulcanizate (sometimes known as a TPV). The color of the wall pad sleeve is a matter of choice. As previously discussed, the size of the wall pad sleeve is determined by the thickness (depth) of the wall pad and the size of the hole.

The wall pad sleeve is typically used with a rectangular hole. However, the wall pad sleeve can also be used with holes of other shapes having straight sides by simply adding additional corner pieces and side rails. For example, a wall pad sleeve for an "L" shape has six corner pieces and six side rails and a wall pad sleeve for a "U" shape has eight corner pieces and eight side rails. The wall pad sleeve can also be used with openings at the edges of a wall pad by omitting one of the side rails and, if desired, two corner pieces.

The wall pad sleeve provides an attractive appearance to the wall pad and prevents damage to the wall pad by completely surrounding the hole in the wall pad. The wall pad sleeve is easily modified to fit holes of varying size by cutting the side rails. The cuts do not require precision because the corner pieces overlap the side rails. The wall pad sleeve fits wall pads of varying depth because its corner pieces and side rails straddle the wall pad. The wall pad sleeve does not require the use of connectors because the corner pieces and side rails connect directly to each other. The wall pad sleeve is easily installed and is durable.

We claim:

1. A wall pad sleeve comprising four corner pieces and four side rails connectable together to form a rectangular assembly for covering a perimeter of a rectangular hole in a wall pad, with each of the four side rails extending between two of the four corner pieces and with each of the four corner pieces connecting two of the four side rails, each of the four corner pieces comprising: (i) a first rectangular base section having a front, a rear, an outer side, and an inner side; (ii) a second rectangular base section having a front, a rear, an outer side, and an inner side, the first base and the second base connected together along the first base inner side and the second base inner side and forming a right angle to each other; (iii) a front flange with an interior face extending from the front of the first base and the front of the second base and being perpendicular to the front base and the second base, and (iv) a rear flange with an interior face extending from the rear of the first base and the rear of the second base and being perpendicular to the front base and the second base, the interior face of the front flange and the interior face of the rear flange defining an interior depth, each of the four side rails comprising: (i) a rectangular base section having a front, a rear, and two sides; (ii) a front flange with an interior face and an exterior face extending from the front that is perpendicular to the base; and (iii) a rear flange with an interior face and an exterior face extending from the rear that is perpendicular to the base, the interior face of the front flange and the interior face of the rear flange defining an interior depth, and the exterior face of the front flange and the exterior face of the rear flange defining an exterior depth, wherein the interior depth of each of the four corner pieces is greater than the exterior depth of each of the four side rails so that each of the four side rails is insertable within each of the four corner pieces with an area of contact, and wherein the rear flange of each of the four corner pieces has a height, wherein the rear flange of each of the four side rails has a height equal to the height of the rear flange of each of the four corner pieces, wherein each rear flange of each of the four corner pieces has a thickness, and wherein the rear flange of each of the four side rails has an upper edge with a connected lip that runs downwardly parallel to the rear flange of the side rail and spaced apart a distance equal to the thickness of the rear flange of each of the four corner pieces for providing an additional area of contact between each of the four corner pieces and each connected side rail.

2. The wall pad sleeve of claim 1 wherein the corner pieces and side rails are made of a thermoplastic vulcanizate.

3. The wall pad sleeve of claim 2 wherein the front flange of each side rail has a height that is less than the height of the rear flange of each side rail.

4. The wall pad sleeve of claim 3 wherein the front flange of each corner piece has an upper edge with an inwardly projecting shoulder.

5. A wall pad assembly comprising:

(a) a wall pad for covering a wall, the wall pad having a front face, a rear face, a depth defined by the distance between the front face and the rear face, and a rectangular opening extending from the front face to the rear face and having a perimeter, and (b) a wall pad sleeve comprising four corner pieces and four side rails connectable together to form a rectangular assembly for covering the perimeter of the rectangular hole in the wall pad and for a portion of the front face of the wall pad and a portion of the rear face of the wall pad, with each of the four side rails extending between two of the four corner pieces and with each of the four corner pieces connecting two side rails, each of the four corner pieces comprising: (i) a first rectangular base section having a front, a rear, an outer side, and an inner side; (ii) a second rectangular base section having a front, a rear, an outer side, and an inner side, the first base and the second base connected together along the first base inner side and the second base inner side and forming a right angle to each other; (iii) a front flange with an interior face extending from the front of the first base and the front of the second base and being perpendicular to the front base and the second base, and (iv) a rear flange with an interior face extending from the rear of the first base and the rear of the second base and being perpendicular to the front base and the second base, the interior face of the front flange and the interior face of the rear flange defining an interior depth, each of the four side rails comprising: (i) a rectangular base section having a front, a rear, and two sides; (ii) a front flange with an interior face and an exterior face extending from the front that is perpendicular to the base; and (iii) a rear flange with an interior face and an exterior face extending from the rear that is perpendicular to the base, the interior face of the front flange and the interior face of the rear flange defining an interior depth, and the exterior face of the front flange and the exterior face of the rear flange defining an exterior depth, wherein the interior depth of each of the four corner pieces is greater than the exterior depth of each of the four side rails so that each of the four side rails is insertable within each of the four corner pieces with an area of contact.

6. The wall pad assembly of claim 5 wherein the rear flange of each of the four corner pieces has a height, wherein the rear flange of each of the four side rails has a height equal to the height of the rear flange of each of the four corner pieces, wherein each rear flange of each of the four corner pieces has a thickness, and wherein the rear flange of each of the four side rails has an upper edge with a connected lip that runs downwardly parallel to the rear flange and spaced apart a distance equal to the thickness of the rear flange of each of the four corner pieces for providing an additional area of contact between each of the four corner pieces and each connected side rail.

7. The wall pad assembly of claim 6 wherein the interior depth of each side rail is equal to or greater than the depth of the wall pad so that each side rail straddles the opening in the wall pad.

8. The wall pad assembly of claim 7 additionally comprising a fastener passing through the rear flange of a side rail into the wall pad to secure the wall pad sleeve to the wall pad.

9. The wall pad assembly of claim 8 wherein the front flange of each corner piece has an upper edge with an inwardly projecting shoulder.

10. A wall pad sleeve consisting of four corner pieces and four side rails connected together to form a rectangular assembly for covering a perimeter of a rectangular hole in a wall pad, with each of the four side rails extending between two of the four corner pieces and with each of the four corner pieces connecting two of the four side rails; each of the four corner pieces comprising a channel with a base, a front flange, and a rear flange; and each of the four side rails comprising a channel with a base, a front flange, and a rear flange, each of the four side rails inserted within two of the four corner pieces such that the front flanges of the corner pieces overlap the front flanges of the side rail, wherein the rear flange of each of the four corner pieces has a height, wherein the rear flange of each of the four side rails has a height equal to the height of the rear flange of each of the four corner pieces, wherein each rear flange of each of the four corner pieces has a thickness, and wherein the rear flange of each of the four side rails has an upper edge with a connected lip that runs downwardly parallel to the rear flange of the side rail and spaced apart a distance equal to the thickness of the rear flange of each of the four corner pieces for providing an additional area of contact between each of the four corner pieces and each connected side rail.

11. The wall pad sleeve of claim 10 wherein the front flange of each corner piece has an upper edge with an inwardly projecting shoulder under which the front flange of each connecting side rail abuts.

* * * * *